US005690272A

United States Patent [19]

England

[11] Patent Number: 5,690,272

[45] Date of Patent: Nov. 25, 1997

[54] PRODUCE BOX

[75] Inventor: James England, Escondido, Calif.

[73] Assignee: Universal Container, Inc., Escondido, Calif.

[21] Appl. No.: 638,611

[22] Filed: Apr. 26, 1996

[51] Int. Cl.[6] ..... B65D 5/32; B65D 21/032

[52] U.S. Cl. ..... 229/23 R; 229/915; 229/916; 229/919

[58] Field of Search ..... 229/23 R, 915, 229/916, 919; 206/509, 511, 512

[56] References Cited

U.S. PATENT DOCUMENTS

| | | | |
|---|---|---|---|
| D. 352,453 | 11/1994 | Bacchetti et al. | D9/418 |
| 2,843,307 | 7/1958 | Goltz . | |
| 2,955,733 | 11/1960 | Wilson . | |
| 3,356,283 | 12/1967 | Champlin . | |
| 3,863,829 | 2/1975 | Merrill . | |
| 3,881,648 | 5/1975 | Hall . | |
| 4,245,771 | 1/1981 | Christian . | |
| 4,353,495 | 10/1982 | Jes . | |
| 4,482,074 | 11/1984 | Lalley | 229/23 R |
| 4,529,117 | 7/1985 | Brundage . | |
| 4,709,852 | 12/1987 | Stoll | 229/915 |
| 4,775,719 | 10/1988 | Markevka et al. | 525/125 |
| 4,884,739 | 12/1989 | Nederveld | 229/916 |
| 4,993,623 | 2/1991 | Kelly et al. | 229/23 R |
| 5,116,290 | 5/1992 | Ross | 229/915 |
| 5,163,069 | 11/1992 | Hayashi . | |
| 5,181,651 | 1/1993 | Oppenheim | 229/121 |
| 5,263,612 | 11/1993 | Nederveld | 229/112 |
| 5,316,207 | 5/1994 | Ross et al. | 229/23 R |
| 5,462,220 | 10/1995 | Bacchetti et al. | 229/112 |
| 5,489,061 | 2/1996 | Fogle et al. | 229/23 R |
| 5,497,939 | 3/1996 | Heiskell et al. | 229/23 R |

*Primary Examiner*—Gary E. Elkins

*Attorney, Agent, or Firm*—Baker, Maxham, Jester & Meador

[57] ABSTRACT

The box is easily assembled by hand, is suitable for construction out of plastic materials, and can be produced at relatively low cost. The box includes an elongated wrap panel with a plurality of flat surfaces formed by folding at lateral creases. The flat surfaces include a bottom surface and two flat surfaces forming a top wherein the two flat surfaces are adjacent to the lateral edges of the wrap panel. Each of the two sides of the box are formed from a plurality of flat surfaces. The box also includes two end panels, each with a plurality of tabs which engage with the box sides and each end panel having a horizontal slit extending there through. The bottom surface of the box includes a locking tab at each end. The locking tab includes a pair of hinged portions permitting the locking tab to fold inward wherein a portion of the bottom surface between the pair of hinged portions forms a flat support tab that is formed by a slit in the locking tab. The locking tab also includes a first generally U-shaped portion and a second generally U-shaped portion extending outward from the first U-shaped portion and hingingly attached to the first U-shaped portion. When assembled, the first U-shaped portion extends into the interior of the box adjacent to the end panel and the second U-shaped portion extends outside the box through one of the horizontal slits in the end panel.

24 Claims, 7 Drawing Sheets

PRODUCE BOX

BACKGROUND OF THE INVENTION

1. Technical Field

The present invention relates to boxes and more particularly to a hand assembled box made of plastic materials which is suitable for shipping produce.

2. Discussion

A wide variety of boxes have been developed for use in transporting and storing produce. While produce boxes vary according to their suitability for specific kinds of produce, they have a number of requirements in common. For example, produce boxes are typically designed to be hand assembled (hand folded) in the field where the produce is picked. It is preferable that produce boxes be hand folded as opposed to pre-assembled because of the space savings in shipping flat unassembled boxes.

Produce boxes must be able to withstand extremes in temperatures. Produce boxes are subjected to relatively hot conditions in the field and to relatively cold conditions in refrigeration units. The humidity may also vary widely from field conditions which may be quite dry, to refrigerated conditions which have significant levels of moisture.

Produce boxes used for fruits need to provide adequate ventilation. Produce boxes need to be strong and able to hold relatively heavy loads of produce. Produce boxes must also withstand the weight of other boxes since the produce boxes are often stacked. For fragile produce such as grapes, it is important that the box be devoid of sharp edges or corners which smash or deform the fruit.

Prior produce boxes typically have been constructed of wood or cardboard. These materials, however, have a number of disadvantages. Wood is relatively expensive and is undesirable for some produce because it has a tendency to extract moisture. Cardboard boxes also extract moisture from produce and become soft in conditions of high humidity such as those encountered in refrigeration units. Cardboard also has limited strength and frequently cannot withstand heavy loads. Due to its limited strength, cardboard boxes may impose strict limits on the stacking height. While attempts have been made to improve the strength of cardboard boxes by coating the cardboard with wax or impregnating the cardboard with various materials, none of these approaches have proved entirely satisfactory.

Cost is also an important factor to consider in the design of produce boxes because of the high volume of produce boxes used. Cost differences of several pennies per box can become a major consideration in the choice of a produce box. Hand assembled cardboard boxes employ a plurality of flaps which increase the amount of material used in the box which in turn increases the cost of the produce box. The additional material used is particularly important because the cost of paper products, including cardboard, is rising rapidly.

Styrofoam has been used as an alternative material to cardboard. However, styrofoam has a number of disadvantages. The necessary thickness to obtain the required strength results in a larger produce box. Environmental considerations weigh against the use of styrofoam materials. Styrofoam designs are also typically preassembled.

Plastic has shown promise in overcoming many of the problems associated with cardboard. For example, the cost of plastic is on a downward trend while the cost of cardboard is rising. Plastic is relatively strong and is not weakened by moist conditions. Plastic does not remove moisture from the produce like cardboard.

While cost of plastic is dropping, it is still relatively high. Therefore, it is very important to minimize the amount of material utilized. Also, problems have been experienced with plastic boxes which require glue to be assembled. Similarly, difficulties have been experienced in developing plastic boxes which are easy to hand assemble in the field.

Therefore, it would be desirable to provide a produce box which overcomes the above-described disadvantages. In particular, it would be desirable to provide a low cost produce box. It would also be desirable to provide such a box which is easy to assemble by hand and which is strong. It would also be desirable to provide a produce box which can withstand extremes in temperature and humidity. Further, it would be desirable to provide the above features in a produce box which utilizes the advantages of plastic materials while overcoming the problems with assembly encountered with prior plastic boxes.

SUMMARY OF THE INVENTION

Pursuant to the present invention, there is provided a hand folded produce box which is strong easy to assemble. The box also can be produced at relatively low cost and is suitable for construction using plastic materials. In particular, in accordance with a preferred embodiment of the present invention, the box is composed of an elongated wrap panel with a plurality of flat surfaces formed by folding at lateral creases. The flat surfaces include a bottom surface and two flat surfaces forming a top wherein the two flat surfaces are adjacent to the lateral edges of the wrap panel. Each of the two sides of the box are formed from a plurality of the flat surfaces. The box also includes two end panels, each with a plurality of tabs which engage in said box sides and each end panel having a horizontal slit extending therethrough. The bottom surface of the box includes a locking tab at each end. The locking tab includes a pair of hinged portions permitting the locking tab to fold upward wherein a portion of the bottom surface, between the pair of hinged portions, forms a flat support tab which is formed by a slit in the locking tab. The locking tab includes a first, generally U-shaped portion, formed from the slit and a second, generally U-shaped portion, extending outward from the first U-shaped portion which is hingingly attached to the first U-shaped portion. When assembled, the first U-shaped portion extends into the interior of the box adjacent to the end panel. The second U-shaped portion extends substantially outside the box through one of the horizontal slits in the end panel.

BRIEF DESCRIPTION OF THE DRAWINGS

The various advantages of the present invention will become apparent to one skilled in the art by reading the following specification and by reference to the following drawings in which.

DETAILED DESCRIPTION OF THE PREFERRED EMBODIMENTS

Figure 1:
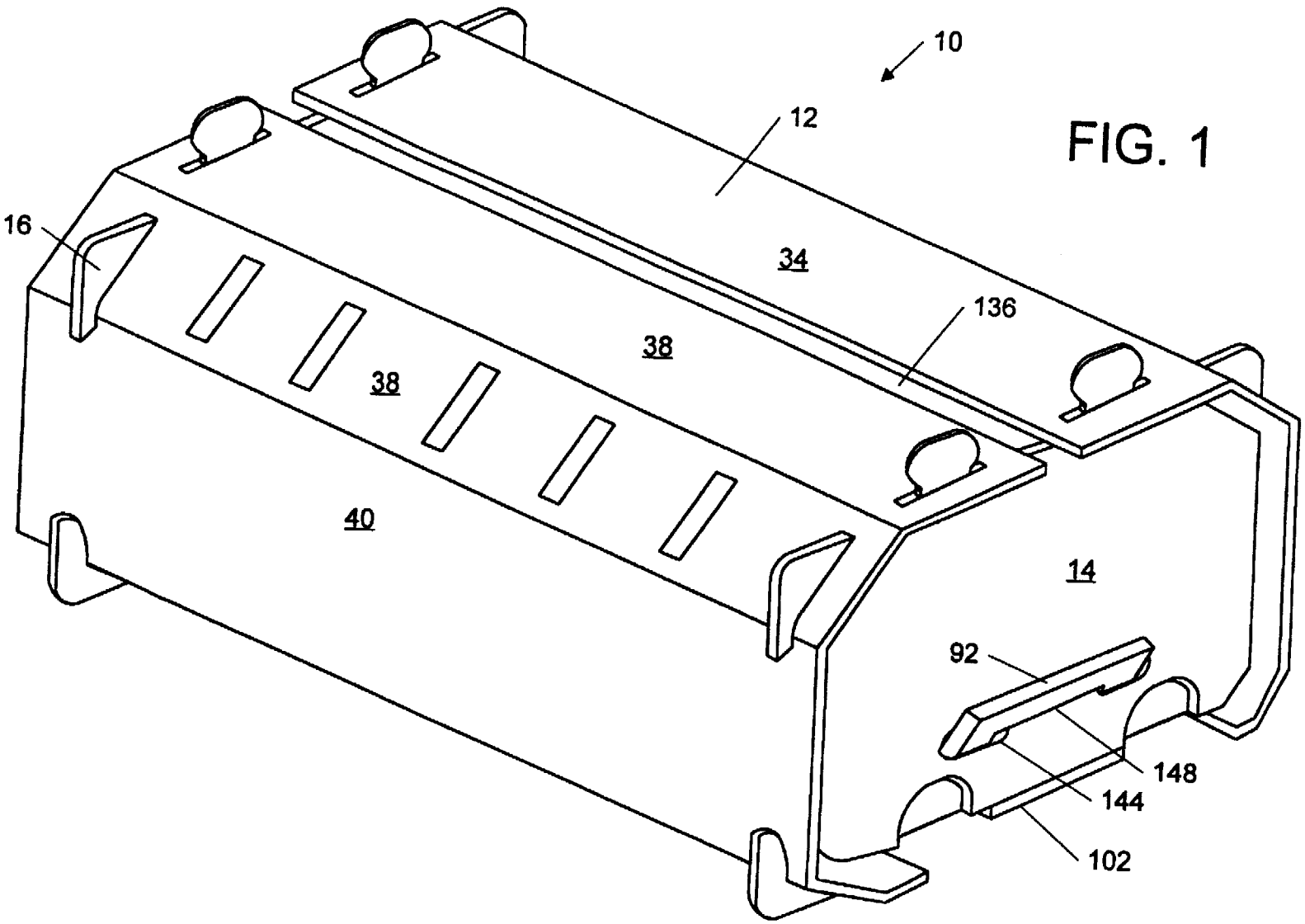
FIG. 1 is a perspective view of a produce box in accordance with a first embodiment of the present invention.

Referring now to FIG. 1, there is shown a first embodiment of a produce box 10 in accordance with the present invention. The produce box 10 is composed of three main pieces, including a wrap panel 12 and two identical end panels 14 and 16.

Figure 2:
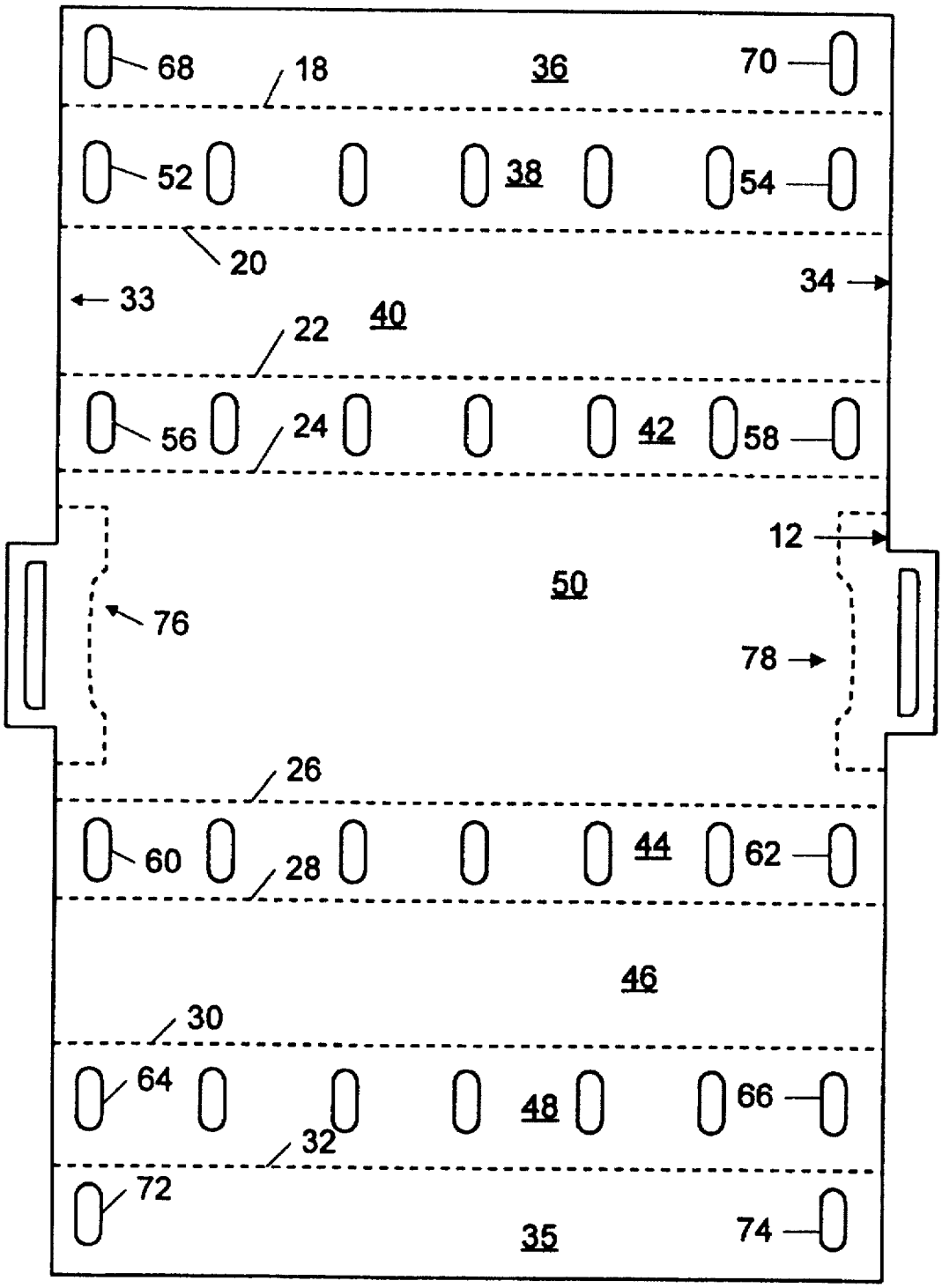
FIG. 2 is a view of the wrap panel in a flattened position used in the box shown in FIG. 1.

Referring now to FIG. 2, the wrap panel 12 is shown in an unwrapped configuration. In the preferred embodiment, the wrap panel 12 includes eight creases 18, 20, 22, 26, 28, 30 and 32 extending longitudinally from edge 33 to edge 34. When folded along the creases 18–32, the wrap panel 12 forms the multiple sides of the produce box 10. In particular, the top of the produce box 10 is formed by panels 35 and 36; one side of the box is formed by panels 38, 40 and 42; and another side of the box is formed by panels 44, 46 and 48. The bottom of the box 10 is formed by panel 50.

Figure 4:
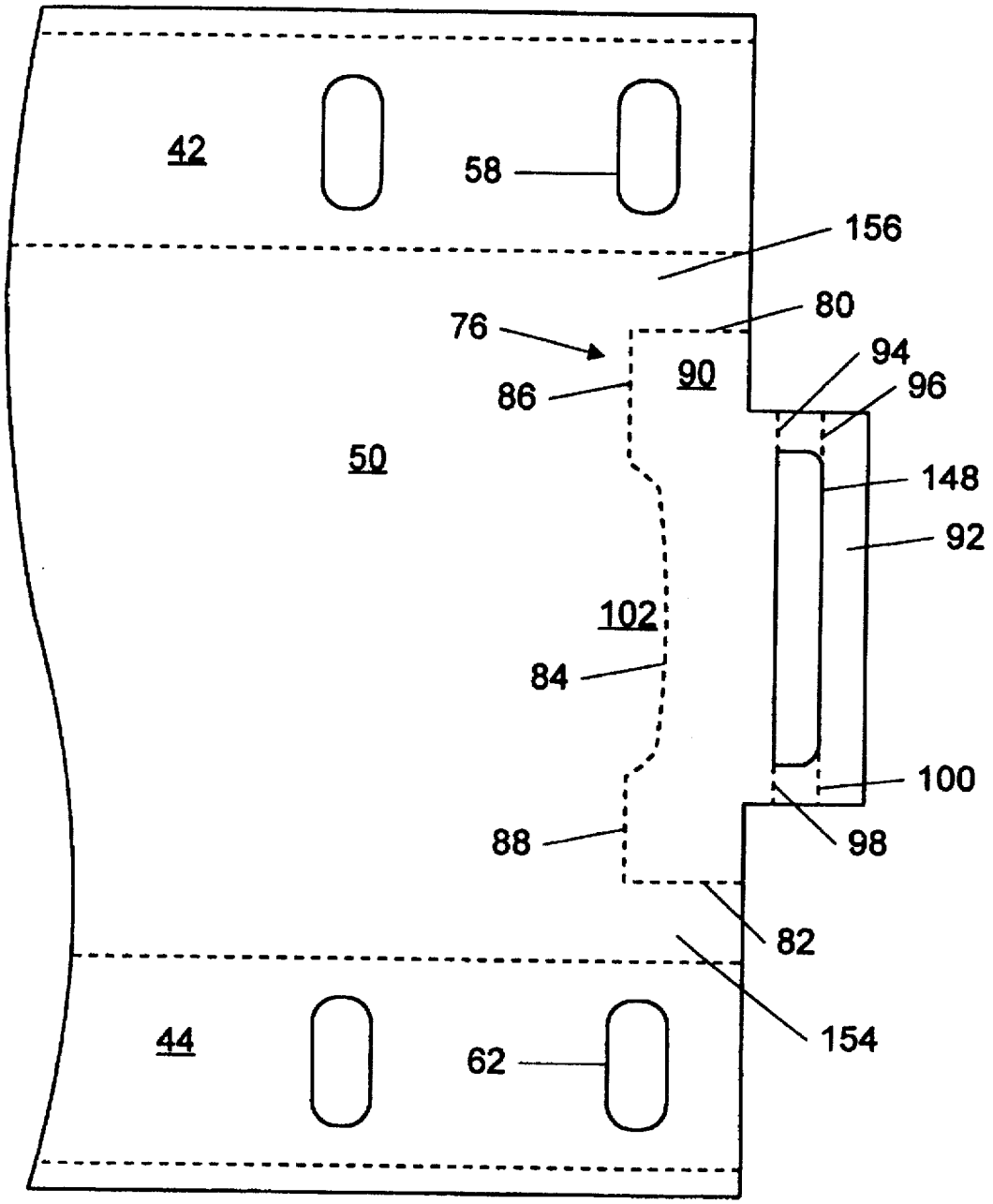
FIG. 4 is a view of a portion of the wrap panel shown in FIG. 2 showing details of the locking tab in accordance with the present invention.

In addition, eight slits in the sides provide a means for securing the end panels 14 and 16. In particular, panel 38 includes slits 52 and 54; panel 42 includes slits 56 and 58; panel 44 includes slits 60 and 62; and panel 48 includes slits 64 and 66 for this purpose. Furthermore, the produce box 10 includes top panels 34 and 36 with slits for securing the end panels 14 and 16. In particular, top panel 36 has slits 68 and 70 and top panel 35 has slits 72 and A pair of locking tabs 76 and 78 are formed in the bottom panel 50. As shown in more detail in FIG. 4, locking tab 76 is formed in the bottom surface 50 by slits 80, 82 and 84. When folded along creases 86 and 88, locking tab 76 comprises a first U-shaped portion 90 and a second U-shaped portion 92. Second U-shaped portion is hingingly attached by means of four creases 94, 96, 98 and 100. Slit 84 also defines support tab 102 as described in more detail below.

Figure 3:
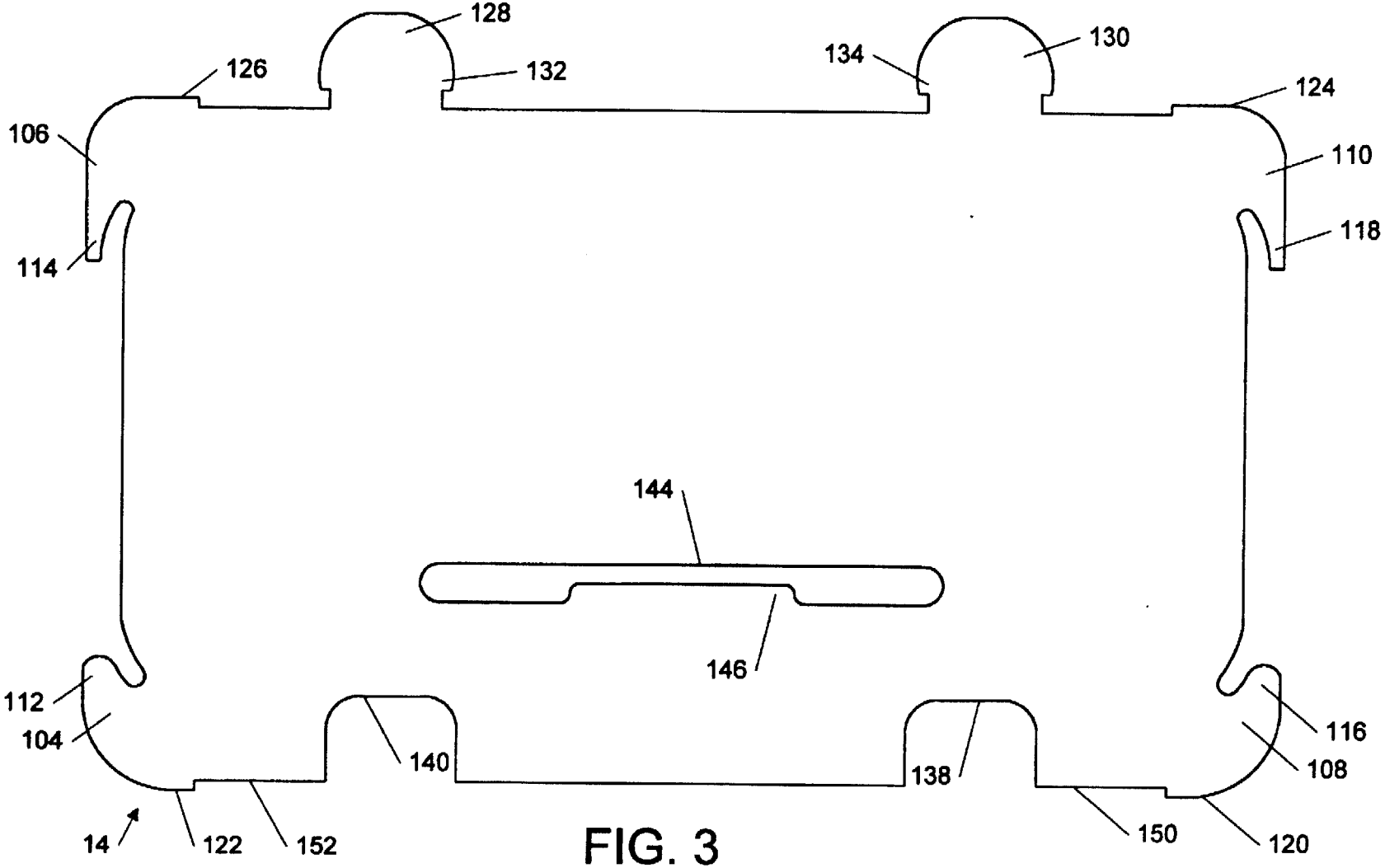
FIG. 3 is a view of the end panel of the box shown in FIG. 1.

Referring now to FIG. 3, there is shown end panel 14. End panel 14, which is identical to end panel 16, includes four tabs 104, 106, 108 and 110 at its four corners. These tabs are inserted into slits 52, 56, 60 and 64. Hook portions 112, 114, 116 and 118 serve to lock tabs 104–110 into place. Furthermore, tabs 104 and 108 include bottom corner surfaces 120 and 122 which serve to stabilize box 10 by resisting rolling motion of produce box 10 onto surfaces 42 and 44. Likewise, tabs 106, 110 include flat surfaces 124 and 126 which provide a resting surface for corresponding tabs 104, 108 in a similar box stacked on top of box 10, and to thereby further stabilize the box 10 on top from tipping.

Stacking tabs 128, 130 are disposed at the top end panel 14 which are inserted into slits 68, 72. Protruding tabs 132 and 134 serve to restrain the top panels 34, 36 from being removed from stacking tabs 128, 130. For example, tabs 132, 134 permit box 10 to be carried by grabbing one or both of the top panels 34, 36 through opening 136 as shown in FIG. 1. Stacking tabs 130, 128 are also designed to engage with stacking recesses 138 and 140 in the side panel 14 of identical box 10 stacked on top of box 10. In this way, stacking tabs 128, 130 keep a stack of identical boxes 10 from shifting when stacked and insures that the stack remains aligned and straight to reduce the likelihood of the stack tipping over.

Also shown in panel 14 is slit 144 into which second U-shaped portion 92 is inserted as shown in FIG. 1. Slit 144 also includes a shallow tab 146 which engages in opening 148 in second U-shaped portion 92 to prevent the inadvertent removal of U-shaped portion 92 from slit 144.

Panel 14 also includes flat resting surface 148 which rests on support tab 102 when box 10 is assembled. In this way, weight applied to end panel 14 rests on support tab 102 at support surface 148. Likewise, additional support is provided on surfaces 150 and 152 by wrap panel surfaces 154 and 156. It should also be appreciated that weight from produce inside of box 10 is supported at the end by support tab 76 at its points of connection 86 and 88. That is, support tab 76 engages within panel 14 through slit 144 and thereby distributes the weight of the produce from the bottom panel 50 to the end panel 14. This configuration is easy to assemble and also prevents bottom panel 50 from sagging when loaded with produce.

To assemble the produce box 10, the wrap panel 12 is wrapped around end panels 14, 16 in a step-by-step fashion. In particular, end panel 14 is placed into the proper position on the open wrap panel 12 and tabs 104, 108 are inserted into slits 56, 60. Next, with the wrap panel still in the partially unfolded configuration, tabs 106, 110 are inserted into slits 52, 64. Finally, with the wrap panel completely wrapped around end panel 14, tabs 128, 130 are inserted into slits 68–70 respectively.

Before completing this process however, locking tabs 76 is first folded upward along creases 86, 88 in a vertical position to dispose it in the interior side of wrap panel 14. Once the end panel 14 is in position, then second U-shaped tab portion 92 is simply inserted into slit 144, so that opening 148 engages with tab 146. A similar procedure is simultaneously followed for the opposite end panel 16.

Figure 5:
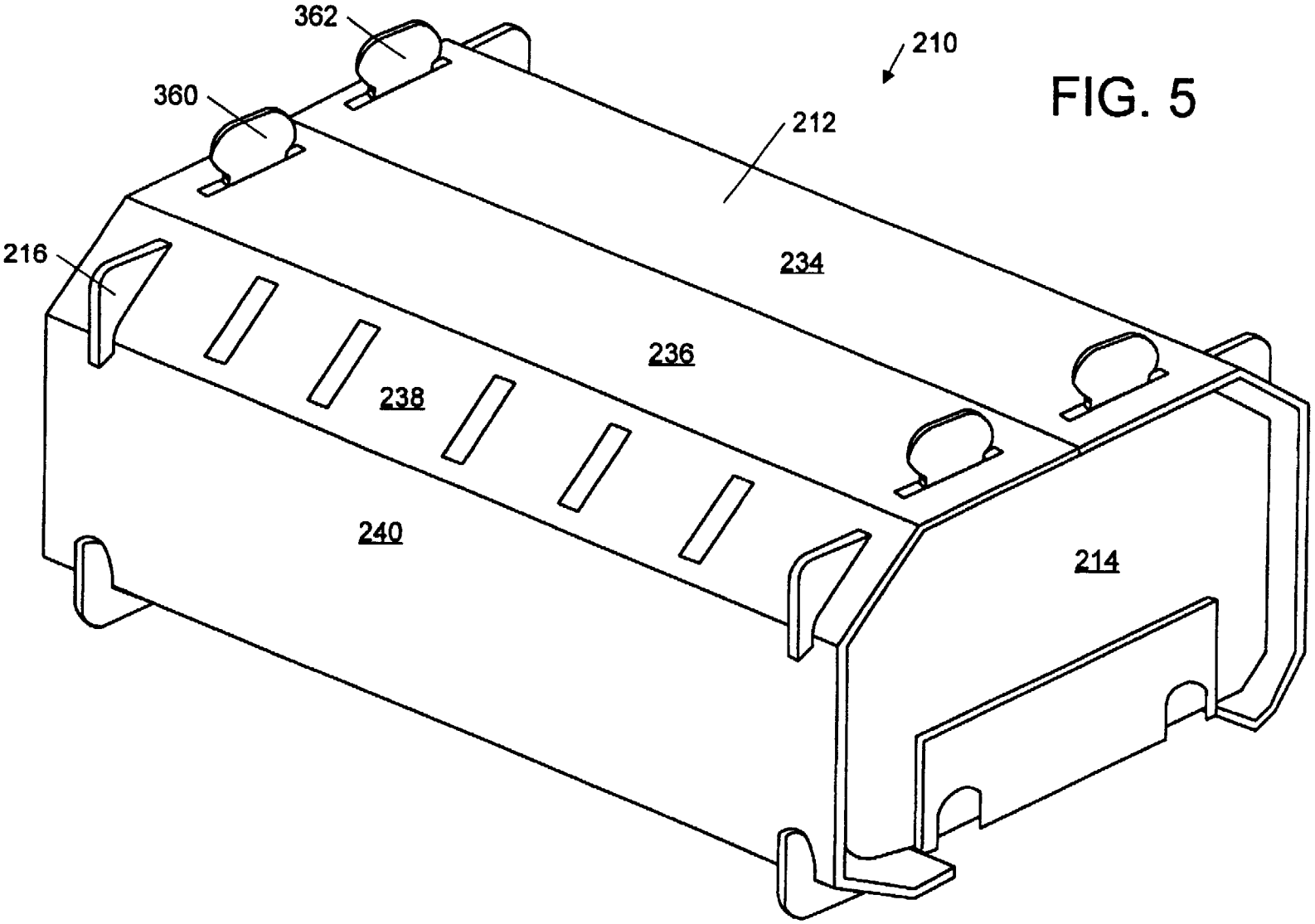
FIG. 5 is a perspective view of a produce box in accordance with a second embodiment of the present invention.

Referring now to FIG. 5, there is shown a second embodiment of a produce box 210 in accordance with the present invention. Box 210 is likewise composed of three main pieces, including a wrap panel 212 and two identical end panels 214 and 216.

Figure 6:
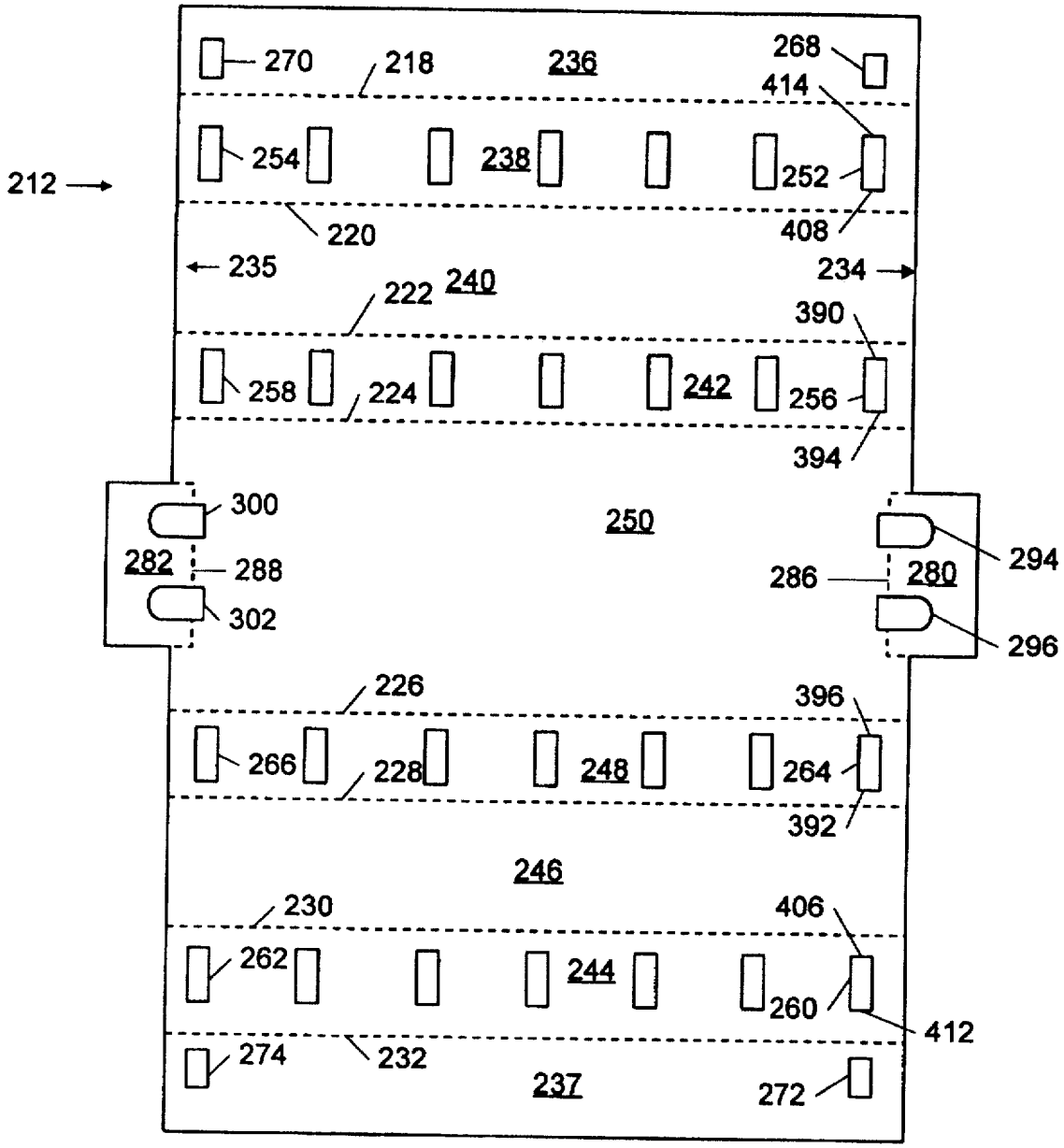
FIG. 6 is a plan view of a wrap panel in a flattened position used in the produce box shown in FIG. 5.

Referring now to FIG. 6, the wrap panel 212 is shown in a unwrapped configuration. In a preferred embodiment, the wrap panel includes eight creases 218, 220, 222, 224, 226, 228, 230, 232 which extend longitudinally from edge 234 to edge 235. When folded along the creases 218-232, the wrap panel 212 forms the multiple sides of the produce box 210. In particular, the top of the produce box 210 is formed by panels 236 and 237; one side of the box is formed by panels 238, 240 and 242; an opposite side of the produce box 210 is formed by panels 244, 246, and 248. The bottom of the produce box 210 is formed by panel 250.

In addition, eight slits in the sides provide a means for securing the end panels 214 and 216. In particular, the panel 238 includes slits 252 and 254; panel 242 includes slits 256 and 258; panel 244 includes slits 260 and 262; and, panel 248 includes slits 264 and 266 for this purpose. Furthermore, the top panels 234 and 236 of the produce box 210 also includes slits for facilitating securing the end panels 214 and 216. In particular, top panel 246 includes slits 268 and 270 and top panel 234 includes slits 272 and 274.

Interlocking panels 280 and 282 extend outwardly from a mid-portion of edges 234 and 235, respectively. Interlocking panels 280 and 282 are folded along creases 286 and 288. Interlocking panel 280 includes first and second U-shaped slits 294 and 296. Likewise interlocking panel 282 includes first and second U-shaped slits 300 and 302.

Figure 7:
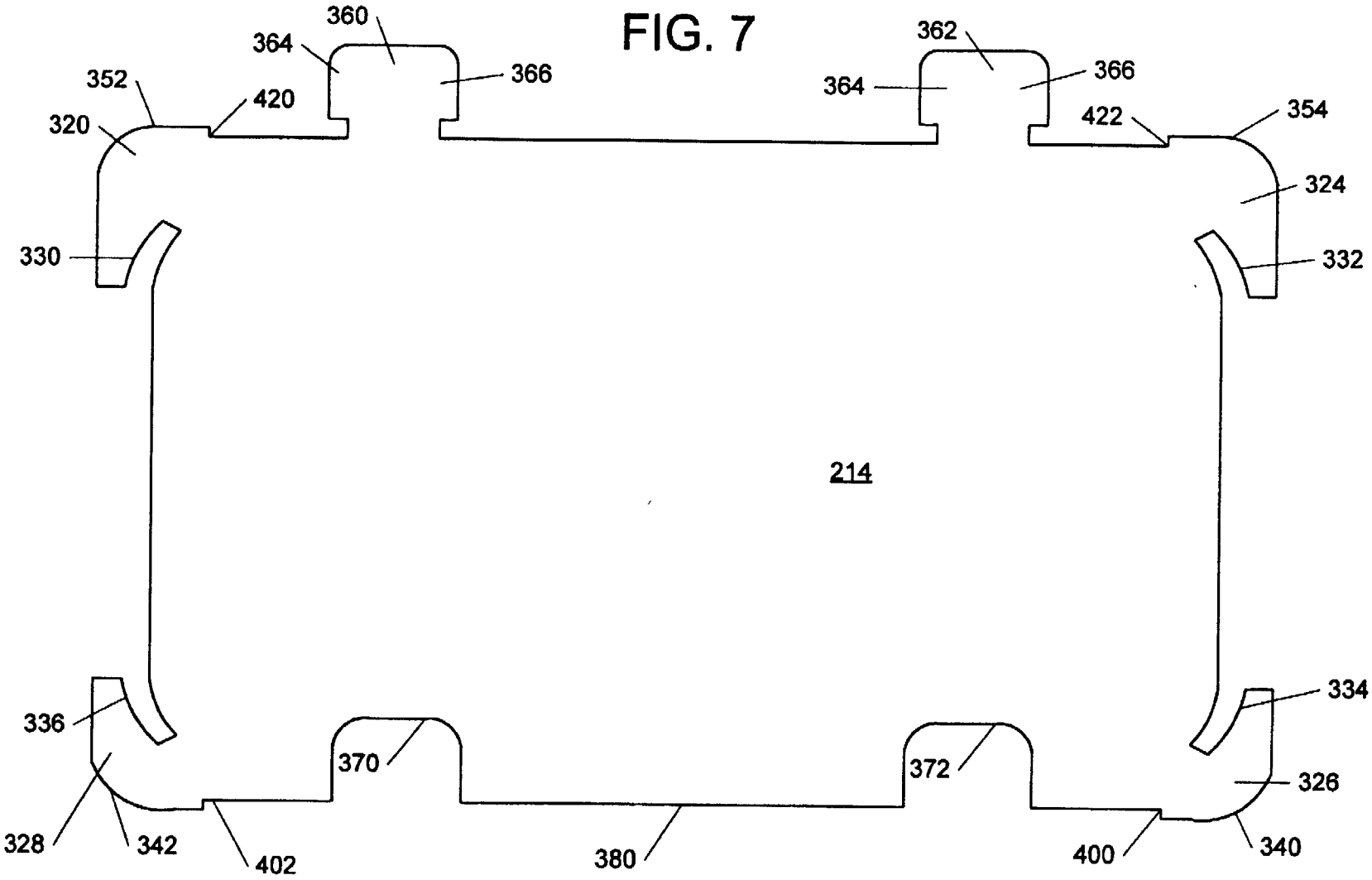
FIG. 7 is a plan view of an end panel for the produce box shown in FIG. 5.

Referring now to FIG. 7, there is shown an end panel 214. End panel 214, which is identical to end panel 216, includes four corner tabs 320, 324, 326 and 328 located at the four corners of end panel 214. Corner tabs 320, 324, 326, and 328 are inserted into slits 254, 258, 262, and 266. Hook portions 330, 332, 334 and 336 serve to lock tabs 320–328 into place.

Furthermore, bottom tabs 326 and 328 include arcuate surfaces 340 and 342 which serve to stabilize produce box 210 by resisting rolling motion of produce box 210 onto surfaces 240 and 242. Likewise, tabs 320, 324 include flat surfaces 352 and 354 which provide a resting surface for corresponding tabs 340 and 342 in similar box stacked on top of produce box 210 and to thereby further stabilize the produce box 210 on top from tipping.

Stacking tabs 360 and 362 are disposed at the top of end panel 214 and are inserted into slits 300, 302. Protruding tabs 364 and 366 serve to restrain the top panels 234, 236 from being removed from stacking tabs 364, 366. Tabs 364, 366 permit produce box 210 to be carried by grabbing one or both of the top panels 234, 236 through the opening between top panels 234, 236. Stacking tabs 360, 362 are also designed to engage with stacking recesses 370 and 372 in the end panel 14 of an identical box 10 which is stacked on top of box 10. In this way, stacking tabs 360 and 362 keep a stack of identical produce boxes 210 from shifting when stacked and insures that the stack remains aligned and straight to reduce the likelihood of the stack tipping over.

End panel 214 further includes a flat resting surface 380 which rests adjacent crease 288 when produce box 210 is assembled. In a preferred embodiment, interlocking panels 280 are adhered to end panel 214 using a hot melt moisture curing adhesive. Preferably, the adhesive is applied in an air tight glue system and a desiccant dryer is employed to remove moisture. In a highly preferred embodiment, PUR hot melt adhesive is employed. PUR hot melt adhesive is product number HL9527 available from H. B. Fuller Company of La Mirada, Calif. and other manufacturers.

To assemble produce box 210, the hot melt moisture curing adhesive is applied to interlocking panels 280 and 282 and/or corresponding portions of end panels 214 and 216. U-shaped slits 294–302 are aligned with corresponding slits 370 and 372 in end panels 214 and 216. Interlocking panel 280 and end panel 214 are positioned at a right angle with respect to wrap panel 212 by folding interlocking panel 280 along crease 286 and interlocking panel 282 along crease 288. Locking tabs 326 and 328 of end panel 214 are inserted through slits 264 and 256. Upper edges 390 and 392 of slits 256 and 264 engage hook portions 334 and 336. Lower edges 394 and 396 of slits 256 and 264 are engaged by flanges 400 and 402. End panel 216 is positioned and engaged in a similar manner.

In a similar manner lower edges 406 and 408 of slits 252 and 260 engage hook portions 330 and 332 of locking tabs 320 and 324. Upper edges 412 and 414 of slits 252 and 260 engage flanges 420 and 422. Produce can be loaded into produce box 210. Finally, slits 268 and 272 are positioned on stacking tabs 360 and 362.

In a preferred embodiment, the produce box is comprised of corrugated plastic material such as polyethylene and polypropylene. In another preferred embodiment of the present invention, the end panels are composed of molded plastic to provide additional strength. In a highly preferred embodiment, the wrap panel is composed of corrugated plastic of 2.5 mm–14 mm thickness and end panels are composed of corrugated plastic of having a 14 mm thickness.

It will be appreciated that the present invention provides a produce box which minimizes material and thereby costs. The box is strong and will not sag under the weight of the produce and stacking. The plastic material of the box will withstand extremes in temperature and humidity without collapsing.

It should also be noted the produce box in accordance with the preferred embodiment has eight sides and employs no 90 degree angles in the wrap panels. This configuration reduces the sharpness of corners which has a tendency to smash or flatten fruit such as grapes. Furthermore, the box of the present invention is easily assembled by hand and will not easily come apart. However, it is relatively easy to open the top panels to remove the box's contents. The box requires no folding or glue in assembly which was a problem with previous plastic boxes.

It will be appreciated that the produce box of the present invention can be created in many different embodiments including for example, various materials, sizes and shapes, while still employing the basic teachings of the present invention. It may also be used for other purposes besides produce. Those skilled in the art can appreciate that other advantages can be obtained from the use of this invention and that modifications may be made without departing from the true spirit of the invention after studying the specification, drawings and following claims.

What is claimed is:

1. A box comprising:

an elongated wrap panel having lateral edges and a plurality of flat surfaces formed by folding at a plurality of lateral creases wherein all said adjacent flat surfaces form angles which are greater than 90 degrees;

said flat surfaces including a bottom surface and two flat surfaces forming a top, wherein the two flat surfaces are adjacent to the lateral edges;

each of two sides of the box being formed from a plurality of said flat surfaces;

two end panels each having a plurality of tabs engaging with said box sides, the two end panels each having a horizontal slit extending therethrough;

said bottom surface having a locking tab at each end, the locking tab including a pair of hinged portions permitting said locking tab to fold upward, wherein a portion of the bottom surface between the pair of hinged portions forms a flat support tab which is formed by a slit in said locking tab, the locking tab including a first, generally U-shaped portion formed from the slit and a second generally U-shaped portion extending outward from said first U-shaped portion being hingingly attached to the first U-shaped portion, wherein said first U-shaped portion extends into the interior of said box adjacent to the end panel when folded at the hinged portions, and wherein said second U-shaped tab extends substantially outside the box through one of said horizontal slits in the end panel.

2. The box of claim 1 wherein said wrap panel has a plurality of slits perpendicular to said lateral creases and in close proximity to the lateral edges of the wrap panel, and wherein said end panels each have a plurality of locking tabs inserted into said slits in said wrap panel.

3. The box of claim 2 wherein said horizontal slits in said two end panels further comprises a short tab engaging with said second U-shaped tab whereby said second U-shaped tab is constrained in its position exterior to said box through the slit in the side panel.

4. The box of claim 2 wherein said locking tabs comprise a hook portion protruding through said slit in the wrap panel and constraining said tab from being disengaged from said slit.

5. The box of claim 2 wherein said end panel include four locking tabs disposed at the four corners of said end panel and each engaging in one slit in said sides of said box.

6. The box of claim 1 wherein said end panel further comprises a pair of stacking tabs on its upper end and wherein said top surfaces of said box include a pair of slits for engaging said stacking tabs therethrough, whereby said stacking tabs constrain lateral motion of an adjacent box placed on top of said box.

7. The box of claim 6 wherein said end panel has a pair of stacking recesses adjacent its bottom side, said stacking recesses being configured to engage with stacking tabs in a second similar box stacked below said box.

8. The box of claim 1 wherein said box is composed of corrugated plastic.

9. The box of claim 1 wherein said wrap panel is comprised of corrugated plastic and said end panels are comprised of molded plastic.

10. The box of claim 1 wherein said portion of said end panel below said horizontal slit rests on said support tab in said bottom surface.

11. A box comprising:

an elongated wrap panel having lateral edges and eight flat surfaces formed by folding at seven lateral creases;

the flat surfaces including a flat bottom surface and two flat surfaces forming a top, the two flat surfaces being adjacent to the lateral edges;

each of two sides of the box being formed from a plurality of said flat surfaces;

two end panels each having a plurality of tabs engaging with said box sides, the two end panels each having a horizontal slit extending therethrough;

said bottom surface having a locking tab at each end, the locking tab including a pair of hinged portions permitting said locking tab to fold upward, wherein a portion of the bottom surface between the pair of hinged portions forms a flat support tab which is formed by a slit in said locking tab, the locking tab including a first, generally U-shaped portion formed from the slit and a second generally U-shaped portion extending outward from said first U-shaped portion being hingingly attached to the first U-shaped portion, wherein said first U-shaped portion extends into the interior of said box adjacent to the end panel when folded at the hinged portions, and wherein said second U-shaped tab extends substantially outside the box through one of said horizontal slits in the end panel.

12. The box of claim 11 wherein said wrap panel has a plurality of slits perpendicular to said lateral creases and in close proximity to the lateral edges of the wrap panel, and wherein said end panels each have a plurality of locking tabs inserted into said slits in said wrap panel.

13. The box of claim 12 wherein said horizontal slits in said two end panels further comprises a short tab engaging with said second U-shaped tab whereby said second U-shaped tab is constrained in its position exterior to said box through the slit in the side panel.

14. The box of claim 12 wherein said locking tabs comprise a hook portion protruding through said slit in the wrap panel and constraining said tab from being disengaged from said slit.

15. The box of claim 12 wherein said end panel include four locking tabs disposed at the four corners of said end panel and each engaging in one slit in said sides of said box.

16. The box of claim 11 wherein said end panel further comprises a pair of stacking tabs on its upper end and wherein said top surfaces of said box include a pair of slits for engaging said stacking tabs therethrough, whereby said stacking tabs constrain lateral motion of an adjacent box placed on top of said box.

17. The box of claim 16 wherein said end panel has a pair of stacking recesses adjacent its bottom side, said stacking recesses being configured to engage with stacking tabs in a second similar box stacked below said box.

18. The box of claim 11 wherein said box is composed of corrugated plastic.

19. The box of claim 11 wherein said wrap panel is comprised of corrugated plastic and said end panels are comprised of molded plastic.

20. The box of claim 11 wherein said portion of said end panel below said horizontal slit rests on said support tab in said bottom surface.

21. The box of claim 16 wherein said stacking tabs includes locking portions to engage with said slits in the top surface to prevent the removal of said locking tabs where said Box is carried by the top surfaces.

22. A box comprising:

a wrap panel including a plurality of flat surfaces formed by folding at a plurality of creases in said wrap panel, said flat surfaces including a bottom surface, opposite side surfaces, and top surfaces, wherein said opposite side surfaces are formed of a plurality of flat surfaces, wherein said wrap panel includes first and second interlocking panels, and wherein said opposite side surfaces and said top surfaces include a plurality of slits; and first and second end panels connected to said wrap panel using said interlocking panels and forming ends of said box, wherein said first and second end panels include:

bottom corners and top corners;

bottom corner tabs near said bottom corners, said bottom corner tabs insertable into said slits of said opposite side surfaces;

top corner tabs near said top corners, said top corner tabs insertable into said slits of said opposite side surfaces; and stacking tabs insertable into said slits of said top surfaces.

23. The box of claim 22 wherein said end panels are adhered to said wrap panel using a hot melt moisture curing adhesive.

24. The box of claim 22 further comprising:

a first set of slits formed in said interlocking panels; and a second set of slits formed in said end panels, wherein said first and second set of slits are aligned and wherein said stacking tabs are inserted in said first and second sets of slits of another box when said another box is stacked on said box.

* * * * *